US006408828B1

(12) United States Patent
Wheeler

(10) Patent No.: US 6,408,828 B1
(45) Date of Patent: Jun. 25, 2002

(54) REDUNDANT INDUCTION SYSTEM FOR INTERNAL COMBUSTION ENGINE

(75) Inventor: J. Lance Wheeler, Arlington, WA (US)

(73) Assignee: W.G.A. Holdings Ltd., Tortola (VG)

( * ) Notice: Subject to any disclaimer, the term of this patent is extended or adjusted under 35 U.S.C. 154(b) by 0 days.

(21) Appl. No.: 09/611,779

(22) Filed: Jul. 7, 2000

Related U.S. Application Data

(60) Provisional application No. 60/142,859, filed on Jul. 7, 1999.

(51) Int. Cl.[7] ..... F02D 41/22
(52) U.S. Cl. ..... 123/479; 123/690
(58) Field of Search ..... 123/479, 690, 123/456, 575, 527, 525, 472

(56) References Cited

U.S. PATENT DOCUMENTS 4,334,406 A * 6/1982 Todd ..... 123/198 D
4,424,785 A * 1/1984 Ishida et al. ..... 123/479
4,683,854 A * 8/1987 Goulet ..... 123/472
4,969,444 A * 11/1990 Zagranski et al. ..... 123/510
5,271,370 A * 12/1993 Shimada et al. ..... 123/575
5,555,873 A * 9/1996 Nolen ..... 123/575
5,605,135 A * 2/1997 Netherwood ..... 123/479
5,775,282 A * 7/1998 Smith ..... 123/576
5,893,352 A * 4/1999 Fujiwara ..... 123/479

* cited by examiner

*Primary Examiner*—Erick Solis
(74) *Attorney, Agent, or Firm*—Sheridan Ross P.C.

(57) ABSTRACT

The plenum of an engine air manifold, coupled to engine cylinders, is provided with a fuel injector. A solenoid prevents supply of fuel to the plenum fuel injector during normal operation of the engine. Upon failure of the primary fuel system, solenoid opens to provide a fuel/air mixture via the manifold, to the engine cylinders, converting the manifold from a dry manifold to a fuel/air mixture manifold. The fuel bus of the primary fuel system preferably receives fuel from, and returns fuel to, a header tank, rather than directly from and to one or more fuel tanks.

2 Claims, 4 Drawing Sheets

REDUNDANT INDUCTION SYSTEM FOR INTERNAL COMBUSTION ENGINE

This application claims priority from Provisional application Ser. No. 60/142,859, filed Jul. 7, 1999.

The present invention relates to a redundant induction (fuel) system for an internal combustion system and, in particular, a redundant induction system which converts a dry manifold to a mixed fuel manifold.

BACKGROUND INFORMATION

In a number of situations it would be useful to provide redundancy in various engine components, such as a situation where malfunction or interruption of engine power can create a safety hazard. Examples include engines for aircraft, engines for racing cars or other high-speed vehicles, engines for emergency use, such as emergency vehicle engines, emergency power sources and the like. Redundancy can also be useful for other less critical applications such as to avoid inconvenience that might result from engine failure or power interruption in ordinary automobile, powerboat, motorcycle engines, portable or fixed electrical generators and the like.

One system in which redundancy may be useful is an ignition system. A redundant ignition system is described in U.S. Pat. 5,713,338 filed Sep. 19, 1995 and incorporated herein by reference. Another system in which redundancy may be useful is an induction (fuel) system. In some types of internal combustion engines, the fuel system is a sequential multi-port fuel injection system, permitting ignition timing and mixture to be adjusted individually for each cylinder and each engine revolution. Some such engines provide a so-called "limp home" made upon (at least partial) failure of the fuel system. However, many such limp home modes provide for severely reduced power output such as a power output of only about 20 to 40 percent normal power. While such limp home mode may be suitable for some applications (such as automobile applications), such severely-reduced power output would be inappropriate for aircraft or other applications. In many aircraft, it is infeasible to attempt a powered landing with only 20 to 40 percent normal power available. Accordingly, it would be useful to provide an induction (fuel) system in which, after (at least partial) failure, a redundant induction (fuel) mode is available producing sufficient power for powered landings such as around 60 to 80 percent normal power (or more).

Many previous multiport injection engines use numerous components to achieve desired functionality including individual sensors for cylinders, individually adjustable fuel injectors for each cylinder, one or more computer, or other, control devices and the like. While it might be possible to provide an engine with a fully redundant multiport system, since failure of the induction system can result from failure of any of the multitude of components, adequate safety for a fully redundant multiport sequential injection system, would require redundancy in each component, so that a fully redundant multi-port sequential system would involve providing two (or more) of each of the sensors, injectors, computers and similar components. Such a system would be extremely costly and complicated to design, fabricate and maintain. Moreover, the additional weight involved in providing all components in redundant fashion may be unacceptable for aircraft or similar applications. Accordingly, it would be useful to provide an induction (fuel) system for an internal combustion engine which can be implemented without duplicating all of the various components of the typical multiport sequential injection system.

Many previous sequential multiport injection systems employ a pressurized "bus" used to provide fuel to the fuel injectors. Typically, there is much more fuel in the bus at any one time than is used during an engine cycle. In many systems, in order to maintain the desired fuel flow and pressure in the bus, the majority of fuel provided to the bus is circulated, i.e. most of the fuel provided to the bus is returned to the fuel tank for later recirculation onto the bus. While this situation is reasonable to implement, when the engine is used in, e.g., an automobile, typically having a single fuel tank, many aircraft have two or more fuel tanks. Often, the (typically manual) controls for routing fuel from various tanks to the engine involve multiple decisions and valve or control manipulations to achieve the desired result. When it is desired to provide a multiport sequential injection engine in an aircraft, having a bus as described above, the decisions and manipulations and the design of conduits and valves involved in properly controlling the flow of fuel are made relatively more complex, e.g. because the need to provide for return of fuel from the bus to the proper fuel tank. The complexity of such manipulations presents a safety issue since erroneous manipulations or decisions can be lead to fuel starvation with potentially catastrophic results. The complexity of the conduit and other designs leads to a system that is costly to fabricate and maintain. Accordingly, it would be useful to provide a multiport sequential injection system which avoids the recirculation of fuel from a bus to one or more of a plurality of fuel tanks.

Additionally, in the above-described bus system, since the majority of fuel entering the bus is merely returned to a fuel tank, it becomes difficult to accurately measure the rate of fuel consumption since metering the flow through the fuel bus is not an indication of consumption. Although it may be possible to measure or calculate the difference between flow out of the fuel tank and return flow into the fuel tank, such systems are relatively expensive to implement and maintain. Accordingly, it would be useful to provide a multiport and sequential injection system employing a bus, which provides a relatively simple and inexpensive fashion of measuring fuel consumption.

SUMMARY OF THE INVENTION

The present invention, in one aspect, involves providing a solenoid-controlled fuel source, such as a fuel injector, in the plenum of the (normally dry) engine air manifold. Upon failure of the primary (multiport sequential) injection system, the solenoid causes fuel to be injected into the (normally dry) air manifold thus providing a source of fuel/air mixture to the cylinders for continued operation (albeit at somewhat reduced power). In one embodiment, a degree of power control is available by providing a barrel or other valve, adjustable by the operator, between the solenoid and the injector. In situations where two or more fuel tanks are involved in the fuel system, an embodiment of the present invention involves providing a header tank which acts as both the source for the multiport sequential injection bus and a sink for fuel recirculated from the bus, obviating the need for decisions or manipulations regarding the destination for recirculated fuel. In this fashion, a flow meter coupled to the header tank (preferably measuring flow into the tank) provides an accurate indication of fuel usage (such as engine consumption plus any venting of the header tank).

In one embodiment, the plenum of an engine air manifold, coupled to engine cylinders, is provided with a fuel injector. A solenoid prevents supply of fuel to the plenum fuel injector during normal operation of the engine. Upon failure of the primary fuel system, solenoid opens to provide a fuel/air mixture via the manifold, to the engine cylinders, converting the manifold from a dry manifold to a fuel/air mixture manifold. The fuel bus of the primary fuel system preferably receives fuel from, and returns fuel to, a header tank, rather than directly from and to one or more fuel tanks.

DETAILED DESCRIPTION

Figure 1:
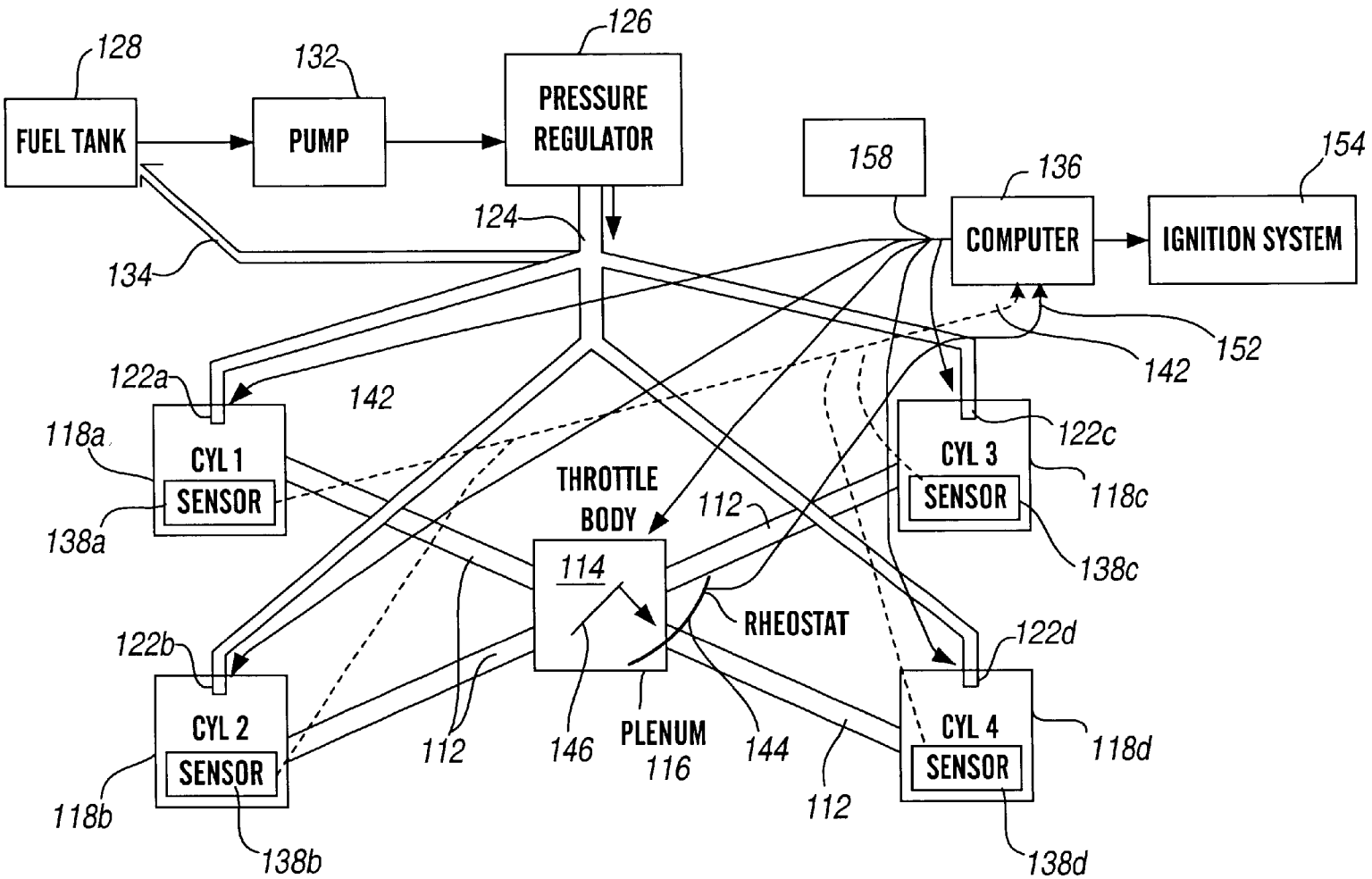
FIG. 1 Prior Art
FIG. 1 is a block diagram depicting certain components of a multiport sequential fuel injection system according to previous devices.

As shown in FIG. 1, previous multiport, sequential fuel injection systems typically provides a drive manifold 112 coupled to a central throttle body 114 (forming a plenum 116) for providing air to the cylinders 118*a, b, c, d*. Each cylinder is provided with a fuel injector 122*a, b, c, d*, receiving fuel from lines of a fuel bus 124 maintained at a desired fuel pressure by a pressure regulator 126 fed fuel from the fuel tank 128 by a pump 132. Fuel is circulated in the bus 124 by returning unused fuel to the fuel tank 128 via a return line 134. A computer 136 receives data from sensors 138*a, b, c, d* via a data line 142 and from a rheostat 144 sensing the position of a butterfly or other valve 146 of the throttle body 114, via a data line 152. Computer 136 can individually control cylinder operation, e g., ignition timing in each cylinder via signals sent to the ignition system 154 (shown, in FIG. 1, only in block form) and signals sent to each fuel injector 122*a, b, c, d* and/or to the throttle 158.

Although FIG. 1 represents a simplified view of a multiport sequential injection system, it illustrates that, in order to provide a completely redundant multiport sequential injection system, the cost and complexity involved in such a redundant system, involving duplication and control of numerous components, may be undesirable.

Figure 2:
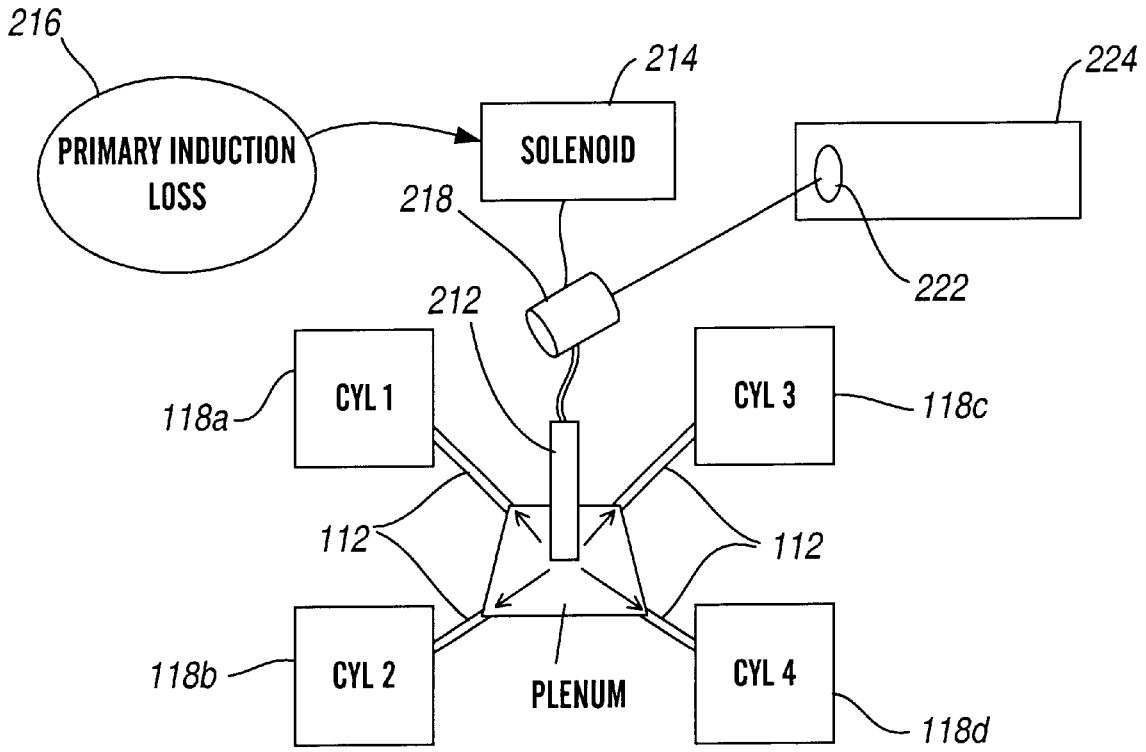
FIG. 2 depicts components of a redundant induction (fuel) system according to an embodiment of the present invention.

FIG. 2 depicts components of a redundant induction (fuel) system according to an embodiment of the present invention. FIG. 2, for the sake of simplicity, does not depict many of the components of the primary induction (fuel) system, but it is contemplated that the redundant system FIG. 2 would be provided in addition to the normal components of the primary system. In the embodiment of FIG. 2, rather than attempting to duplicate a multiport injection system, the redundant system of FIG. 2 provides for delivering a fuel/air mixture to the cylinders via the manifold 112. Thus, in the case of failure of the primary induction (fuel) system, manifold 112 is converted from a dry manifold as depicted in FIG. 1 (carrying only air) to a manifold which provides a fuel/air mixture to the cylinders. In the embodiment of FIG. 2, this is implemented by providing a single fuel injector 212 for delivering fuel to the central region, such as the throttle body or plenum, of the manifold system. Preferably, the injector 212 is configured to output four fuel jets directed down the respective arms of the manifold 112 for delivery of the fuel air mixture to the cylinders 118*a, b, c, d*.

During normal use, while the primary fuel system is operating properly, a solenoid 214 will be maintained in a closed or "off" position, preventing flow of fuel to the central (redundant) fuel injector 212. In case of loss of the primary induction (fuel) system function 216, the solenoid 214 changes to a open or "on" state allowing flow of fuel (as described below) to the central injector 212 for delivery of a fuel-air mixture to the cylinders 118*a, b, c, d*. Preferably, a valve such as a barrel valve 218, adjustable via a control 222 preferably positioned in the cockpit 224, can be used to adjust the rate of flow of fuel to the injector 212 so that the pilot or operator can adjust engine power, e.g. for landing or other flight control purposes.

Figure 3:
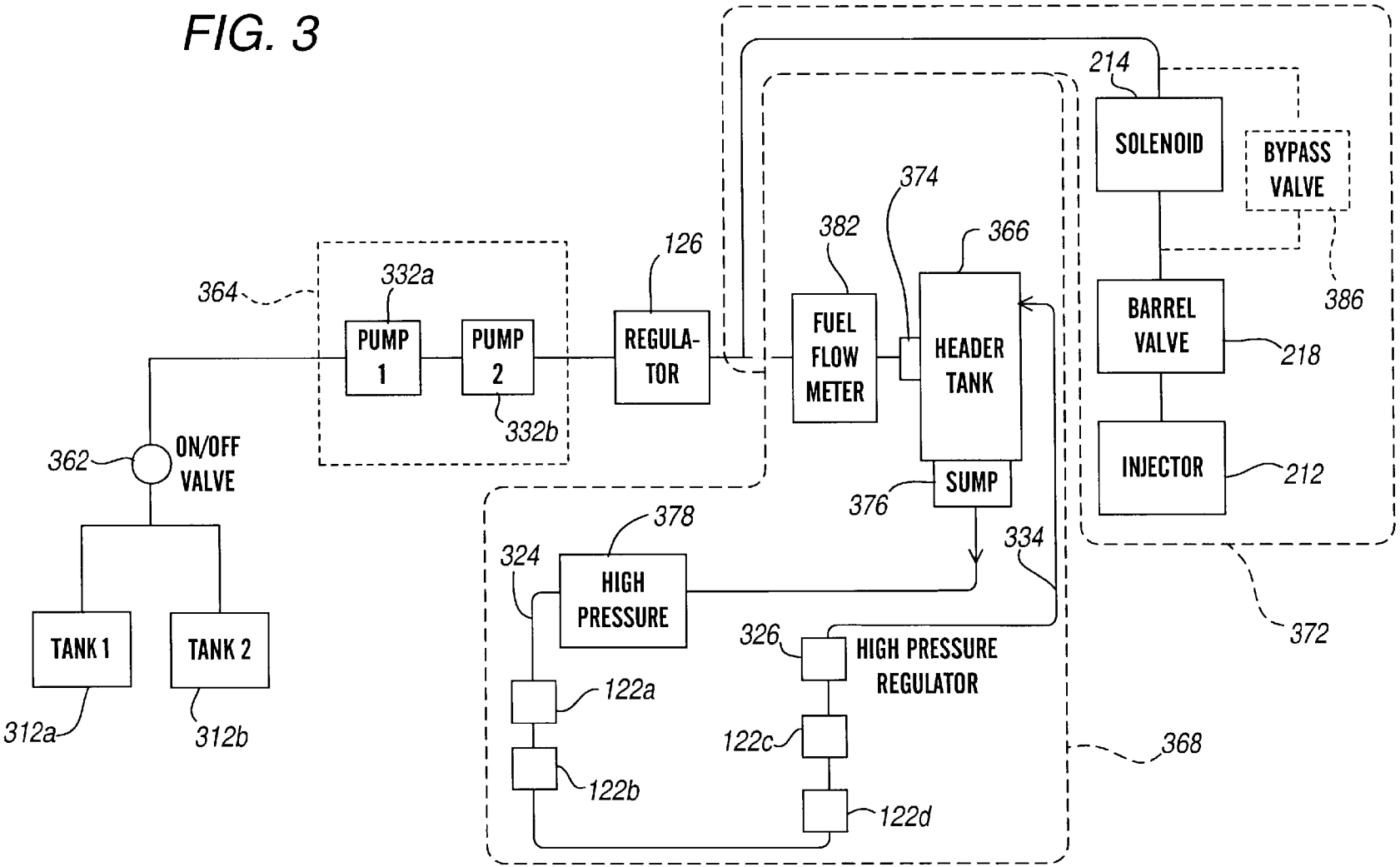
FIG. 3 is a block diagram depicting components of a redundant induction (fuel) system according to an embodiment of the present invention.

FIG. 3 depicts a system including both the primary system fuel injectors 122*a, b, c, d* and redundant system components, namely the injector 212, barrel valve 218 and solenoid 214. In the system of FIG. 3, flow from first and second tanks 312*a, b* are controlled by an on/off valve 362 for supplying a pump system 364. Although it may be possible to use a single pump, in the embodiment of FIG. 3, first and second series-connected pumps 332*a, b* are provided. This configuration provides redundancy such that pressure (for purposes described below) is available even upon failure of one of the pumps 332*a*, 332*b*. In one embodiment, each pump 332*a*, 332*b* is capable of developing pressure rise of about 5 psi (pounds per square inch) and the series-connected pump system can provide a pressurize rise of about 8 psi. A pressure regulator 126 may be used for establishing a constant output pressure such as about 5 psi. This constant pressure of fuel is provided both to the solenoid 214 of the redundant system and to the (controlled) input to a header tank 366. As noted above, during normal engine operation, when the primary system 368 is operating properly, the solenoid 214 is in the off or closed position such that the secondary or redundant system 372 is not operating. Nevertheless, preferably a pressurized fuel supply is constantly maintained available to the solenoid 214 such that, in case of primary system failure, the secondary system 372 can begin substantially instant operation, by opening up the solenoid 214.

The header tank 366 is preferably maintained at a substantially constant level such as at about 80 percent capacity. For this purpose, a float control or other volume control 374 controls flow of fuel from the pressurized output of the regulator 126 into the header tank 366. Thus, when the level of fuel in the header tank 366 falls below a predetermined level, causing the float of the float control 374 to fall below a predetermined level, a valve of the float control 374 opens, allowing additional fuel to flow from the regulator 126 into the header tank 366. Preferably, a warning is provided to the pilot or operator if the level of fuel in the header tank 366 drops below a predetermined level. Preferably, overfilling and/or pressurization of the header tank 366 is avoided by a one-way valve (not shown) near the top of the header tank 366 which vents fuel 367 from the header tank 366 as the level of fuel or pressure of fuel in the other tank rises above a predetermined level. In one embodiment, vented fuel is drawn overboard, by the venturi effect of air flow along the fuselage.

A sump 376 formed in the header tank 366 is the source for fuel provided to a high pressure pump 378 for pressurizing the bus 324 which supplies fuel to the injectors 122*a, b, c, d* in the primary system 368 (similar to the fashion described above in connection with FIG. 1). A high pressure regulator 326 maintains the desired pressure in the bus 324 such as about 55 psi. As described above, fuel which is not consumed by the injectors 122*a, b, c, d* is returned via a return line 334. However, in the configuration of FIG. 3, the return line 334, rather than returning to the tanks 312*a*, 312*b*, returns fuel to the header tank 366. In this way, manipulations, valves, controls and the like that might otherwise be required for returning fuel to the proper tank 312*a*, 312*b* are eliminated, since all returned fuel is returned to the same location, namely the header tank 366. By providing a header tank 366, this advantageous configuration is available, regardless of whether the header tank 366 is used in conjunction with a secondary system 372.

Another advantage of the header tank 366 is that, regardless of the rate of flow into the bus 324 and returning to the header tank 334, the (typically smaller) rate of flow from the regulator 126 into the header tank 366 is indicative of the amount of fuel used (i.e. consumption by the engine plus any venting or similar loss). Accordingly, in one embodiment, a fuel flow meter 382 (fuel flow transducer) measures the rate of flow of fuel into the header tank providing an accurate indication of fuel use.

Figure 4:
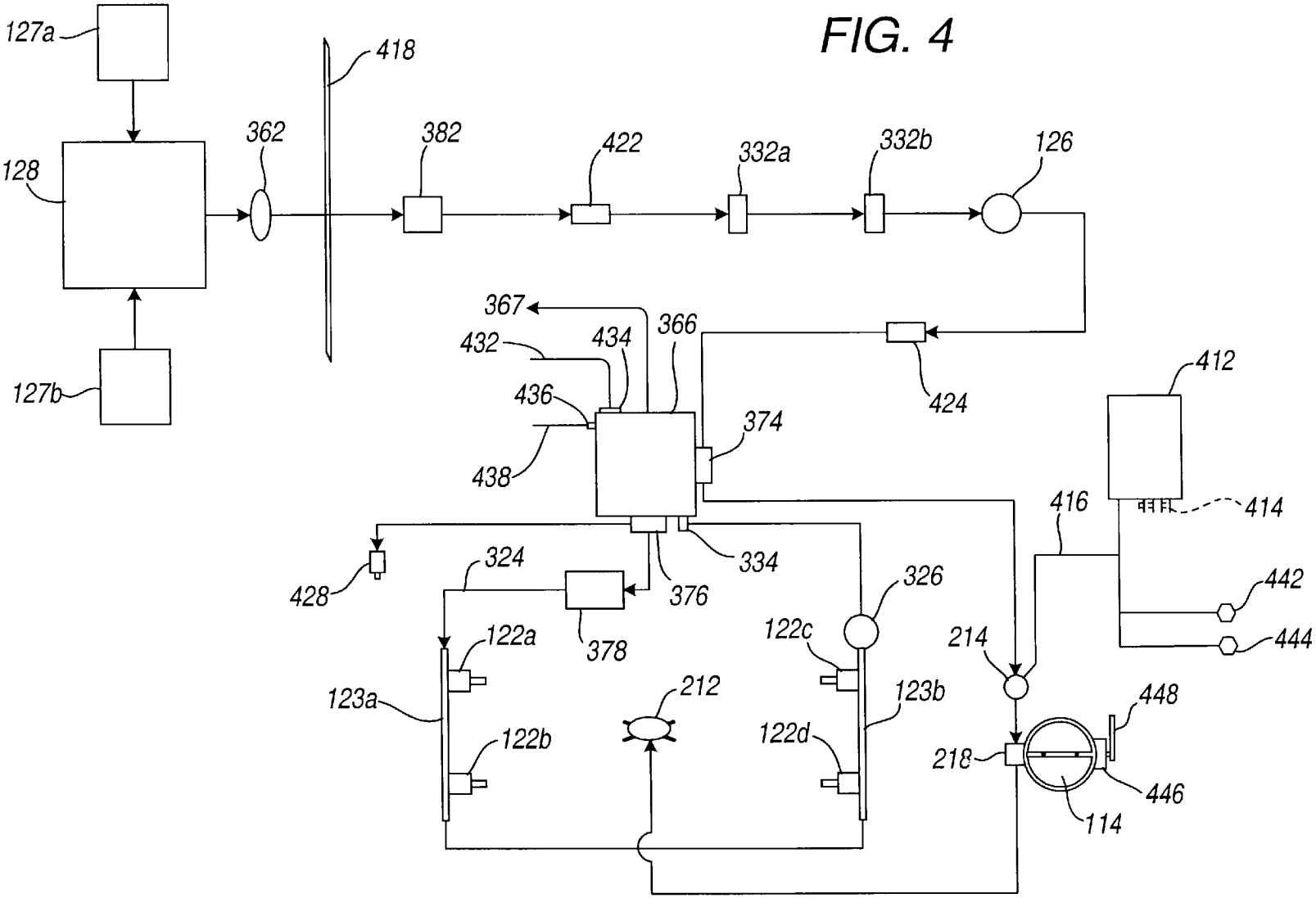
FIG. 4 is a block diagram depicting components of a redundant induction (fuel) system according to an embodiment of the present invention.

FIG. 4 is a more detailed block diagram depicting a redundant fuel injection system according to an embodiment of the present invention. In the embodiment of FIG. 4, an electronic fuel injection control module 412 provides control signals 414 for controlling the fuel injectors 122*a,b,c,d* coupled to engine-mounted fuel injector rails 123*a,b*, as well as a control signal 416 for controlling the low pressure solenoid valve 214. The control signal 416 controlling the low pressure valve can be provided either from the electronic control module 412 or from a high pressure fuel switch. The solenoid valve 214 is activated when either the fuel pressure switch detects low pressure in the bus 324 (preferably also shutting down the electronic fuel injection computer thus turning off the primary injection system) or if the electronic fuel injector computer 412 goes into a predefined failure mode such as a third level failure mode. In either case, the primary injection and emission system is shut down and a redundant injection is placed on-line.

In the embodiment of FIG. 4, a main fuel tank 128 and first and second auxiliary fuel tanks 127*a,b* proceed, via a main fuel shut-off valve 362 through the fire wall panel 418 to the fuel flow transducer 382. As described above, first and second low pressure (e.g. 6 psi) fuel pump 332*a*, 332*b*, via a low pressure (e.g. 4.5 psi) fuel regulator 126 and, possibly including one or more filters (such as a 60 micron fuel filter 422 and/or a 40 micron fuel filter 424) supply a header tank 366. The sump 376 of header tank 366 may be coupled to a header fuel tank water check/fuel drain (located outside the engine compartment) 428. A fuel level signal lead 432 is provided to a panel gage (not shown) and preferably a fuel level sending unit (e.g. float type resistance unit) 434 is used for sensing the level. If desired, a low fuel level warning switch (e.g. normally-open float level type) 436 and/or low level signal lead to a panel indicator/audio intercom 438 may be provided.

When conditions are sensed which would dictate switching to the redundant fuel system, a panel mounted "primary injection system failure" warning indicator light 442 is illuminated and/or a "primary injection system failure" warning tone signal 444 is provided, e.g. to the intercom system, and fuel is provided via the injector 212 for delivering fuel to the central region, such as the throttle body 114 or plenum, of the manifold system. Preferably, the injector 212 is configured to output four fuel jets directed down the respective arms of the manifold 112 for delivery of the fuel air mixture to the cylinders 118*a, b, c, d*. The throttle body 114 is preferably coupled to an electronic fuel injection throttle position switch 446 and a throttle lever 448.

In use prior to any failure of the primary fuel system, the redundant system will be inoperable (because of the closed state of the solenoid 214) and the engine will operate normally in the multiport sequential injection mode without the need for operator control or attention to the redundant system. In the case of a sufficiently serious failure of the primary fuel system, the secondary system described herein can be activated. Preferably, activation occurs substantially automatically and substantially instantaneously. In one configuration, the computer 136 can activate the secondary fuel system in response to parameters of the primary system falling below certain threshold values (which will vary depending on the type of engine). In one embodiment, the solenoid 214 is configured such that it automatically reverts to an open position upon loss of control or power signals. In one embodiment, the pilot or operator can manually initiate operation of the redundant system, via manually sending a signal for opening the solenoid 214 and/or manually operating a bypass valve 386. Preferably, some or all of the above-described procedures for initiating the redundant fuel system are provided as part of the redundant induction system. Preferably, warning signals such as lights, headset or other audible warnings and the like are provided to the pilot or operator in case of detection of failure of the primary system and/or upon initiating of the secondary system. Preferably, the secondary system is configured such that, upon activation, such as opening the solenoid valve 214 or bypass 386, mixture is provided to the cylinders in a relatively short amount of time such as less than about 10 seconds, preferably less than 5 seconds and more preferably within about 1 second of opening the value 214, 386. Preferably the system is configured such that a relatively large portion of normal power is available during secondary induction system operation, such as about 60 to 80 percent power. The pilot or operator can control the amount of power by manipulating the barrel valve control 222.

In light of the above description, a number of advantages to the present invention can be seen. The present invention provides for a back-up or redundant induction (fuel) system that can be used as a back-up upon failure of a primary system (such as a primary multiport sequential injection system) and which provides a substantial portion of normal power, such as 60 to 80 percent of normal power or more, preferably to provide sufficient power for aircraft landings and the like. The present system allows for control of fuel flow by the pilot or operator during redundant induction system operation. The present invention provides for a redundant or back-up induction system at reduced cost by avoiding duplication of all the various components of the primary system. The present invention simplifies return flow from the fuel bus of a multiport injection system by providing a header tank which can be fed from any or all of a plurality of primary fuel tanks. The present systems permits relatively inexpensive and accurate metering of fuel usage, e.g. by measuring flow into a header tank.

A number of variations and modifications of the present invention can be used. It is possible to use some aspects of the invention without using others. For example, it is possible to provide for conversion of a dry manifold to a fuel-air manifold, as part of the redundant system without providing a header tank. Similarly, it is possible to provide a header tank system without providing a redundant fuel or induction system. Although certain components have been described as providing various features herein, other components may be used for similar functions, as will be apparent to those of skill in the art after understanding the present disclosure. For example, it may be possible to provide fuel air mixture to the engine air manifold plenum using a carburetor system, rather than an injector or to use two or more injectors. Although certain controls and other functions are described as being performed by a computer, other control devices can be implemented such as application specific integrated circuits (ASIC) or programmable gate array logic controls, pneumatic controls, vacuum controls, mechanical controls and the like. Although it is anticipated that the present invention may be of particular benefit in an aircraft engine, the present invention can also be used in other types of engines including automobile engines, powerboat engines, electrical generator engines, compressor and the like.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A redundant fuel system for use in conjunction with a primary fuel system, the primary system including an air manifold coupled to engine cylinders and to a central plenum, the primary system providing separate fuel injectors for each cylinder during normal operation of the primary fuel system, the secondary system comprising:

fuel input device for delivering fuel to said plenum;

a control for preventing flow of fuel to said fuel input device during normal operation of said primary fuel system, said control comprising a solenoid; and a flow rate control valve positioned between said solenoid and said fuel input device, said flow rate control valve comprising a barrel valve.

2. A redundant fuel system for use in conjunction with a primary fuel system, the primary system including an air manifold coupled to engine cylinders and to a central plenum, the primary system providing separate fuel injectors for each cylinder during normal operation of the primary fuel system, the secondary system comprising:

fuel input device for delivering fuel to said plenum;

a control for preventing flow of fuel to said fuel input device during normal operation of said primary fuel system; and first and second separate pumps for providing pressurized fuel to said fuel input device, said first and second pumps being series-connected.

* * * * *